US008608303B2

(12) United States Patent
Murayama et al.

(10) Patent No.: US 8,608,303 B2
(45) Date of Patent: Dec. 17, 2013

(54) INK JET RECORDING HEAD

(75) Inventors: Hiroyuki Murayama, Kawasaki (JP); Yoshinori Tagawa, Yokohama (JP); Mitsuru Chida, Yokohama (JP); Kazuhiro Asai, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 146 days.

(21) Appl. No.: 13/288,141

(22) Filed: Nov. 3, 2011

(65) Prior Publication Data

US 2012/0140000 A1 Jun. 7, 2012

(30) Foreign Application Priority Data

Dec. 7, 2010 (JP) ..... 2010-272470

(51) Int. Cl.
*B41J 2/175* (2006.01)
*B41J 2/05* (2006.01)

(52) U.S. Cl.
USPC ..... 347/93; 347/65

(58) Field of Classification Search
None
See application file for complete search history.

(56) References Cited

U.S. PATENT DOCUMENTS

| | | | | |
|---|---|---|---|---|
| 6,264,309 | B1 | 7/2001 | Sullivan | |
| 7,287,847 | B2 * | 10/2007 | Fujii et al. | 347/93 |
| 7,753,502 | B2 | 7/2010 | Fujii et al. | |
| 7,862,158 | B2 | 1/2011 | Fujii et al. | |
| 7,901,064 | B2 | 3/2011 | Urayama et al. | |
| 8,037,603 | B2 | 10/2011 | Fujii et al. | |
| 8,047,632 | B2 | 11/2011 | Fujii et al. | |
| 8,322,825 | B2 * | 12/2012 | Xie et al. | 347/54 |

FOREIGN PATENT DOCUMENTS

JP 2005-178364 A 7/2005

* cited by examiner

*Primary Examiner* — Geoffrey Mruk
(74) *Attorney, Agent, or Firm* — Fitzpatrick, Cella, Harper & Scinto

(57) ABSTRACT

An ink jet recording head capable of maintaining ink supply capability for a long period of time includes a substrate provided with a plurality of energy generating elements and an ink supply port, and a flow path member which has a plurality of discharge ports, a plurality of ink flow paths in communication with the plurality of discharge ports, and a common liquid chamber in communication with the plurality of ink flow paths. The common liquid chamber is divided into a discharge port area and a drainage port area, and the ink flows into the discharge port area through a filter. In the case where a smallest diameter among the diameters of the discharge ports and the diameters of the ink flow paths is denoted by A and a largest diameter of openings of the filter is denoted by B, A≥B is satisfied.

8 Claims, 7 Drawing Sheets

INK JET RECORDING HEAD

BACKGROUND OF THE INVENTION

1. Field of the Invention

The present invention relates to an ink jet recording head provided with a filter.

2. Description of the Related Art

In recent years, an ink jet recording device and an ink jet printer have been required to provide performance for ensuring high-speed printing and high-image-quality printing. As methods for satisfying such a demand, there have been known a method to increase the number of nozzles and a method for reducing the size of an ink droplet.

Methods for reducing the size of an ink droplet are typically represented by a method for reducing the sizes of discharge ports. In this case, the sizes of the discharge ports are reduced to approximately a few micrometers. In a manufacturing process, however, there are cases where foreign substances, such as wastes, accidentally enter into nozzles, or foreign substances that move together with ink reach the discharge ports. If the sizes of such foreign substances are smaller than the sizes of the discharge ports, then the foreign substances can be discharged out of an ink jet recording head when ink is discharged or the ink jet recording head is initialized or during a recovery sequence. If, however, the sizes of the foreign substances are larger than the sizes of the discharge ports, then the foreign substances will clog the discharge ports or ink flow paths. This prevents the specified discharge performance of the ink jet recording head from being exhibited, resulting in deteriorated yield with a consequent increase in cost.

As a solution to the aforesaid problem, it has been known to provide an ink jet recording head with a filter. For example, U.S. Pat. No. 6,264,309 and Japanese Patent Application Laid-Open No. 2005-178364 have proposed a construction in which a membrane type filter is disposed in an upstream portion of an ink flow path.

SUMMARY OF THE INVENTION

However, in the construction according to the U.S. Pat. No. 6,264,309 and the Japanese Patent Application Laid-Open No. 2005-178364, foreign substances that are larger than the sizes of the openings of the filter do not reach the ink flow paths or the discharge ports, whereas they continue to be trapped by the filter. There is a permissible range of the volume of foreign substances that can be trapped by the filter, and if the volume exceeds the permissible range, the capability of ink supply to the discharge ports will be impaired, leading to a deteriorated ink discharge characteristic. An object of the present invention is to solve the aforesaid problem by providing a highly reliable ink jet recording head capable of maintaining ink supply capability for a long period of time.

An ink jet recording head according to the present invention includes a substrate provided with a plurality of energy generating elements for discharging ink and an ink supply port for supplying the ink to the energy generating elements, and a flow path member which has a plurality of discharge ports for discharging the ink corresponding to the plurality of energy generating elements, a plurality of ink flow paths in communication with the plurality of discharge ports, and a common liquid chamber in communication with the plurality of ink flow paths, wherein the common liquid chamber is divided by a shield wall into a discharge port area including the discharge ports and a drainage port area including a drainage port through which the ink is drained, the ink flows into the discharge port area through a filter, and in the case where a smallest diameter among the diameters of the discharge ports and the diameters of the ink flow paths is denoted by A and a largest diameter of openings of the filter is denoted by B, $A \geq B$ is satisfied.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

Ink Jet Recording Head

During the manufacture or use of an ink jet recording head, foreign substances, such as wastes, occur in an ink jet recording head. In the ink jet recording head according to the present invention, the ink that reaches discharge ports always passes through the openings formed in a filter. The diameters of the openings are set to be smaller than a narrowest portion of an ink path including a common liquid chamber, ink flow paths and discharge ports, so that foreign substances that are larger than the openings are captured by the filter of an ink supply port, thus preventing the foreign substances from clogging the ink flow paths or the discharge ports. Further, the diameters of drainage ports are set to be larger than the diameters of the openings, so that the captured foreign substances are discharged out of the ink jet recording head through the drainage ports by a refreshing operation normally performed. This arrangement enables semi-permanently maintained ink supply capability.

Figure 1:
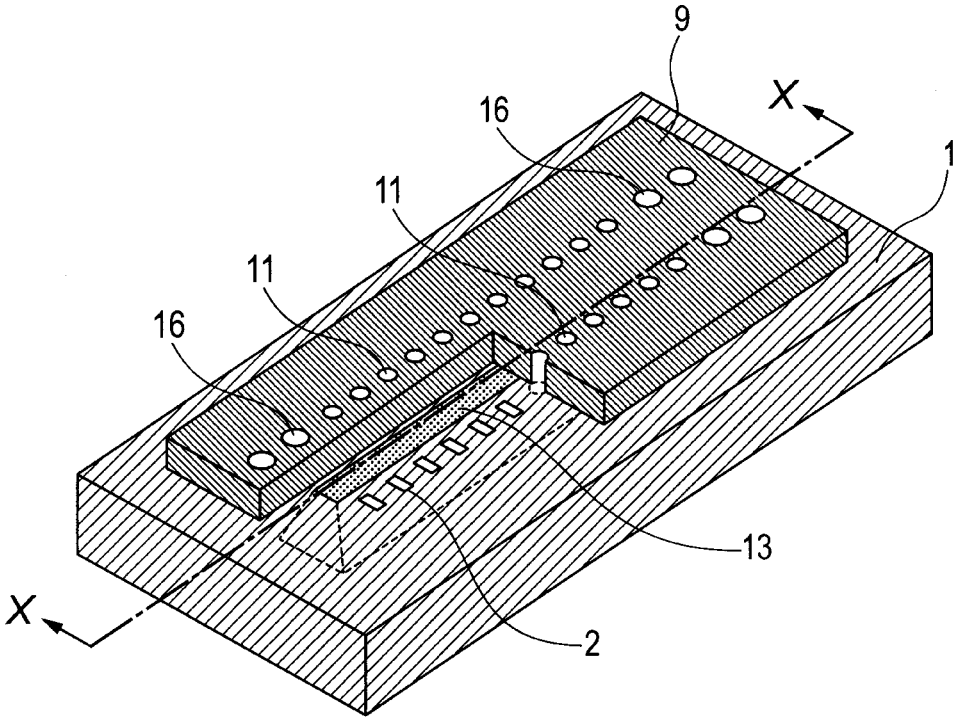
FIG. 1 is a schematic diagram illustrating an ink jet recording head in accordance with the present invention.

An example of the ink jet recording head in accordance with the present invention will be described with reference to FIG. 1. FIG. 1 is a schematic diagram illustrating an ink jet recording head according to an embodiment of the present invention.

The ink jet recording head according to the present embodiment has a substrate 1, a plurality of energy generating elements 2 being disposed at predetermined intervals in two rows on a surface thereof. In the substrate 1, an ink supply port 13 formed by anisotropic etching is disposed between the two rows of the energy generating elements 2. The substrate 1 has a flow path member 9, which provides discharge ports 11 corresponding to the energy generating elements 2 and ink flow paths 21 (not shown in FIG. 1) in communication with the discharge ports 11 from the ink supply port 13. Provided at both ends of the rows of the discharge ports 11 are drainage ports 16. The ink jet recording head is disposed such that the surface in which the discharge ports 11 are formed faces against the recording surface of a recording medium. The energy generated by the energy generating elements 2 is applied to the ink filled in the ink flow paths 21 through the ink supply port 13, thereby discharging ink droplets from the discharge ports 11. The ink droplets are attached to the recording medium so as to carry out recording.

(First Embodiment)

Figure 2A:
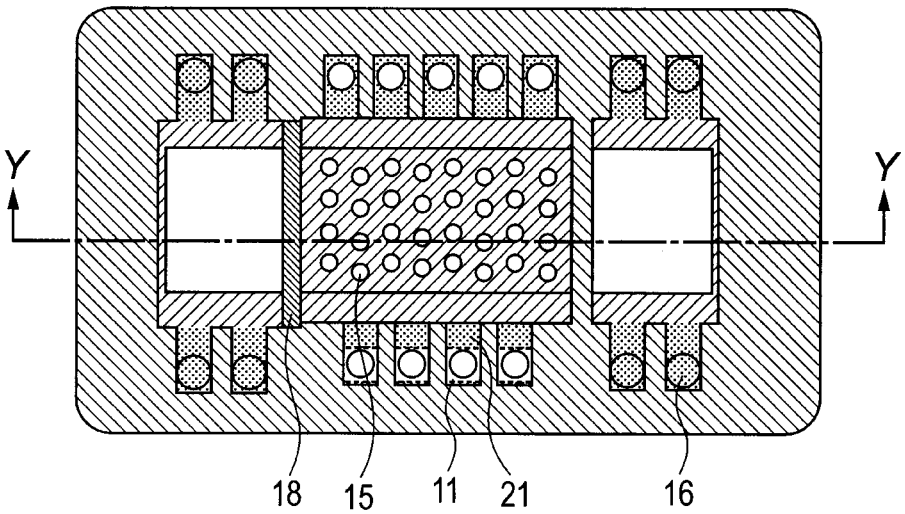
FIG. 2A is a top plan perspective view of an area around discharge ports of an ink jet recording head according to a first embodiment.
Figure 2B:
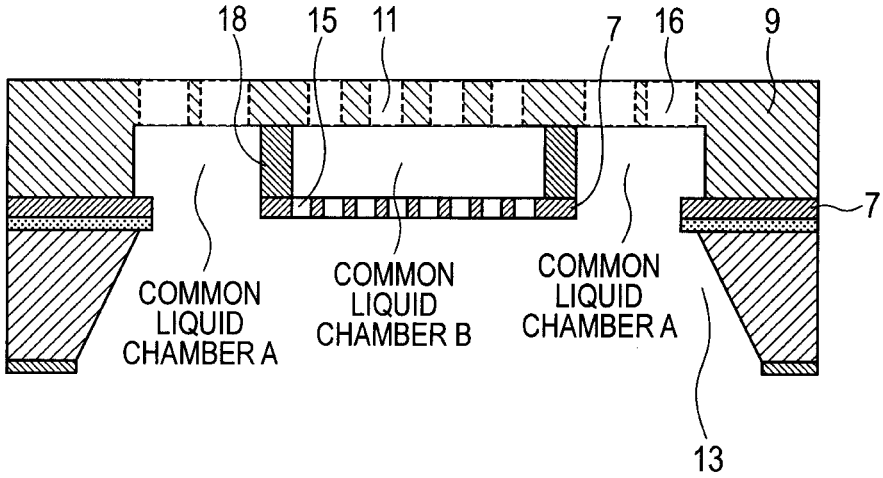
FIG. 2B is a sectional view taken at line Y-Y of FIG. 2A.

An ink jet recording head according to a first embodiment of the present invention will be described with reference to FIGS. 2A and 2B. FIG. 2A is a top plan perspective view of the area around discharge ports 11 of the ink jet recording head according to the present embodiment, and FIG. 2B is a sectional view taken at line Y-Y of FIG. 2A which also corresponds to a sectional view taken at line X-X of FIG. 1.

As illustrated in FIG. 2A, the ink jet recording head according to the present embodiment has two rows of discharge ports consisting of discharge ports 11, which have predetermined diameters, the two rows sandwiching an ink supply port 13. Further, filters 7 with predetermined openings 15 formed therein are disposed on the substrate surface side of the ink supply port 13 such that the filters 7 partly cover the ink supply port 13. Further, drainage ports 16 are provided at both ends of the rows of the discharge ports 11 of a flow path member 9. If the smallest diameter among the diameters of the discharge ports 11 and the diameters of ink flow paths 21 in communication with the discharge ports 11 is denoted by A, while the largest diameter of the plurality of the openings 15 is denoted by B, then A≥B is satisfied. If the smallest diameter of a plurality of drainage ports 16 is denoted by C, then C≥B is preferably satisfied. Further, if the largest diameter of the plurality of the drainage ports 16 is denoted by O, then O is preferably larger than A (O>A) in removing foreign substances captured by the filter, which will be discussed hereinafter. Incidentally, the "diameter" in the present invention means the largest diameter of holes. For example, if the discharge ports or the openings are true circles, then the term "diameter" refers to the length of the diameter, or if they are squares, then the term means the length of a diagonal line.

Of the common liquid chambers in communication with the discharge ports 11 and the drainage ports 16, a drainage port area (common liquid chamber A) is in communication with the drainage ports 16, while a discharge port area (common liquid chamber B) is in communication with the discharge ports 11. The discharge port area including the discharge ports and the drainage port area including the drainage ports for draining ink are partitioned by a shield wall. The common liquid chamber B is separated from the common liquid chamber A by the flow path member 9, a shield wall 18 in contact with the substrate surface, and the filter 7 having openings 15. Thus, the ink flows into the discharge port area (the common liquid chamber B) through the filter. A foreign substance that is larger than the diameters of the openings 15 of the filter does not pass through the openings 15 provided in the filter 7 to reach the discharge ports 11. On the other hand, a foreign substance that is smaller than the openings 15 is allowed to pass through the openings 15 provided in the filter 7 and reach the discharge ports 11. However, the foreign substance will not clog the discharge ports 11 because of the sizes of the respective diameters described above, thus ensuring smooth printing. Preferably, however, the ink does not flow into the drainage port area through the filter. In FIG. 2B, no filter is interposed between the drainage port area (the common liquid chamber B) and the ink supply port 13. This enables easy draining of foreign substances from the drainage ports and provides efficient performance of the refreshing operation.

Normally, while the ink jet recording head is in use, the refreshing operation for sucking the ink out of the ink jet recording head by suction from the surface of the flow path member 9 is routinely performed in order to prevent a discharge failure caused by dried ink in the discharge ports 11 and the ink flow paths 21. In the present embodiment, the foreign substances in the ink or the foreign substances captured by the filter 7 can be discharged out of the ink jet recording head through the drainage ports 16 by the flow of the ink caused by the refreshing operation. If the diameters of the drainage ports 16 are larger than the diameters of the discharge ports 11, then the ink flowing toward the drainage ports 16 during the refreshing operation is faster, causing the foreign substances captured by the filter 7 to be led to the drainage ports 16. For this reason, O is preferably larger than A (O>A), as previously mentioned. Further, a foreign substance discharging operation in which the suction from only the drainage ports 16 rather than the suction from the discharge ports 11 and the drainage ports 16 at the same time is preferably performed, because the ink will flow only from the ink supply port 13 to the drainage ports 16, permitting more efficient ejection of the foreign substances out of the ink jet recording head. Further preferably, when carrying out the refreshing operation, the ink is made to flow backward to cause the foreign substances on the filters 7 to float in the ink and then the suction is performed. Then the foreign substances can be ejected out of the ink jet recording head with even higher efficiency.

According to the present embodiment, the drainage ports 16 are disposed two each at both ends of the rows of the discharge ports 11, as illustrated in FIG. 2A; however, the arrangement of the drainage ports 16 is not limited thereto. One or more drainage ports 16 may be provided at both ends of the rows of the discharge ports 11. Further, according to the present embodiment, C≥B is satisfied; however, it is acceptable as long as the diameter of at least one of the plurality of the drainage ports 16 is larger than B.

(Second Embodiment)

Figure 3A:
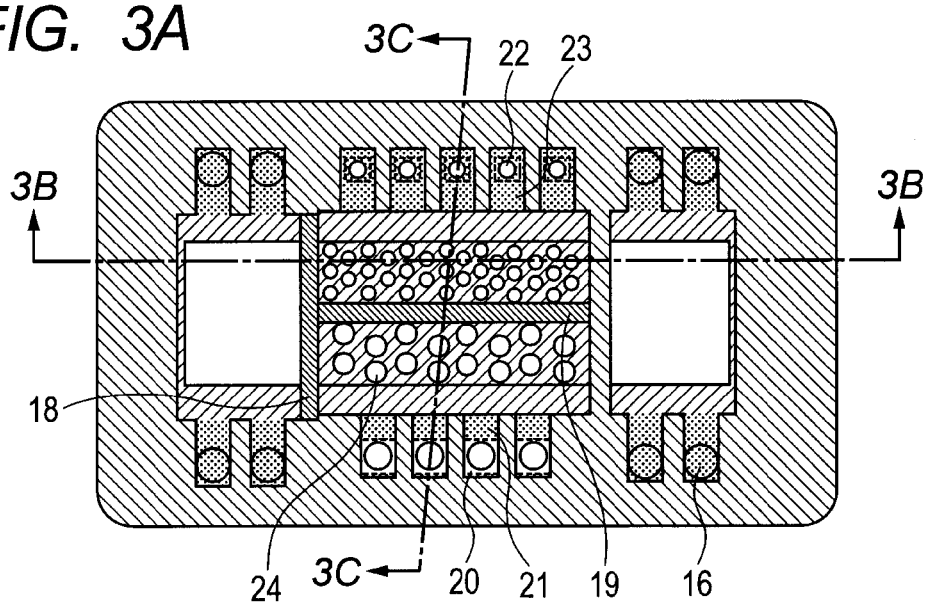
FIG. 3A is a top plan perspective view of an area around discharge ports of an ink jet recording head according to a second embodiment.
Figure 3B:
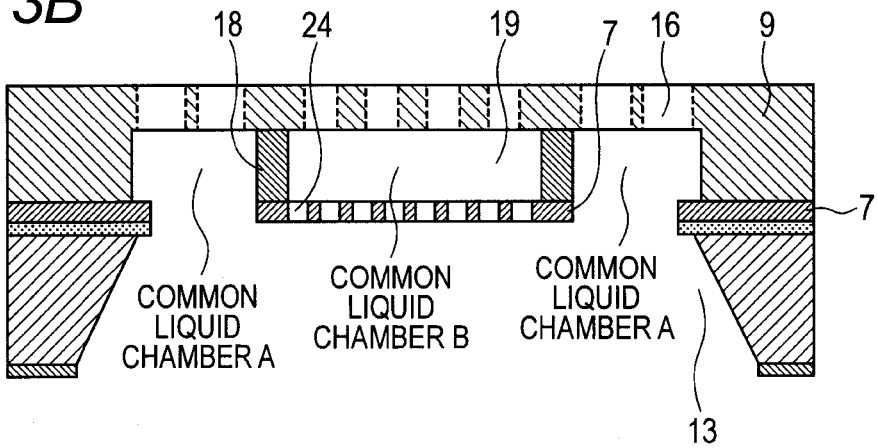
FIG. 3B is a sectional view taken at line 3B-3B of FIG. 3A.
Figure 3C:
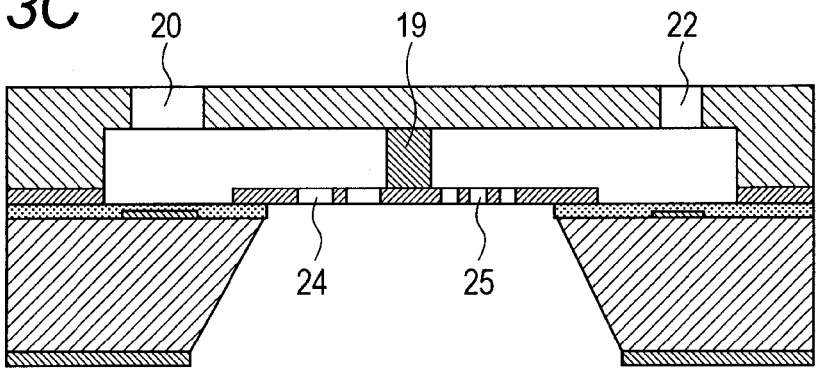
FIG. 3C is a sectional view taken at line 3C-3C of FIG. 3A.

An ink jet recording head according to a second embodiment of the present invention will be described with reference to FIGS. 3A to 3C. FIG. 3A is a top plan perspective view of an area around discharge ports of the ink jet recording head according to the present embodiment, FIG. 3B is a sectional view taken at line 3B-3B of FIG. 3A which also corresponds to a sectional view taken at line X-X of FIG. 1, and FIG. 3C is a sectional view taken at line 3C-3C of FIG. 3A.

Unlike the first embodiment, according to the second embodiment, two rows of discharge ports have different diameters of discharge ports, and a discharge port row consists of a row of first discharge ports 22 and a row of second discharge ports 20. The second discharge ports 20 are larger than the first discharge ports 22, so that the row of the second discharge ports 20 is capable of discharging larger ink droplets than the ink droplets discharged from the first discharge ports 22. An ink supply port 13 is provided at a position between the row of the first discharge ports and the row of the second discharge ports. As illustrated in FIG. 3C, a supporting member 19 for supporting filters 7 with openings and shield walls 18 is provided between the filters 7 and a flow path member 9. The supporting member 19 is capable of preventing the filters 7 from being pushed by an ink flow and damaged if, for example, ink gushes into a common liquid chamber B from the ink supply port 13, thus permitting higher strength of the filters 7 against physical damage. The common liquid chamber B, which is a discharge port area, is separated by the supporting member 19 into a first discharge port area including the row of the first discharge ports and a second discharge port area including the row of the second discharge ports. The sizes of the openings formed in the filters 7 differ, the supporting member 19 being the boundary of the difference.

If a smallest diameter among the diameters of the first discharge ports 22 and the diameters of an ink flow paths 23 in communication with the first discharge ports 22 is denoted by D and a largest diameter of openings 25 provided in the filter 7 in the area of the row of the first discharge ports is denoted by E, then a condition denoted by D≥E is satisfied. Further, if a smallest diameter among the diameter of the second discharge ports 20 and the diameter of an ink flow path 21 in communication with the second discharge ports 20 is denoted by F and a largest diameter of openings 24 provided in the filter 7 in the area of the row of the second discharge ports is denoted by G, then a condition denoted by F≥G is satisfied. Thus, in the path from the ink supply port 13 to the first discharge ports 22 and the second discharge ports 20, the openings 25 and the openings 24 formed in the respective filters 7 will have the smallest diameters, so that foreign substances will not clog the ink flow paths 23 and 21, and the first discharge ports 22 and the second discharge ports 20. Further, the captured foreign substances are ejected from drainage ports 16 at regular intervals, as with the first embodiment, so that foreign substances will not accumulate in the ink jet recording head.

In the present embodiment, if the largest diameter of the openings 24 provided in the filter 7 in the area of the row of the second discharge ports is denoted by H, while the largest diameter of the openings 25 provided in the filter 7 in the area of the row of the first discharge ports is denoted by I, then a condition denoted by H≥I is preferably satisfied.

(Third Embodiment)

Figure 4A:
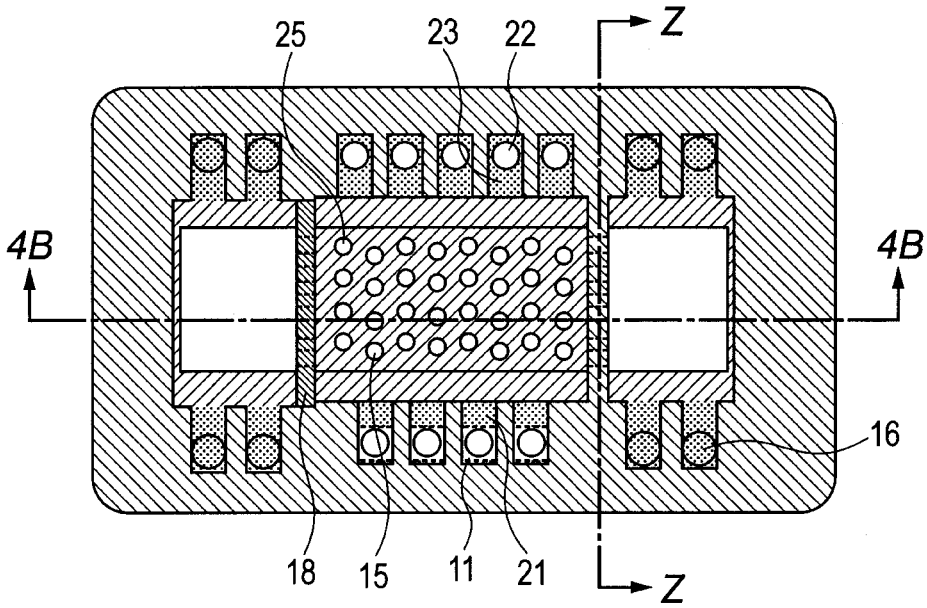
FIG. 4A is a top plan perspective view of an area around discharge ports of an ink jet recording head according to a third embodiment.
Figure 4B:
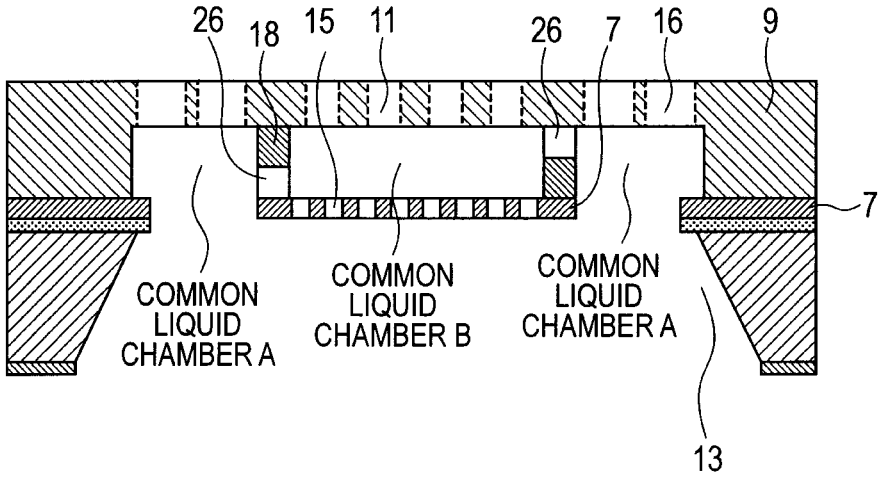
FIG. 4B is a sectional view taken at line 4B-4B of FIG. 4A.

An ink jet recording head according to a third embodiment of the present invention will be described with reference to FIGS. 4A and 4B. FIG. 4A is a top plan perspective view of an area around discharge ports of the ink jet recording head according to the present embodiment, and FIG. 4B is a sectional view taken at line 4B-4B of FIG. 4A which also corresponds to a sectional view taken at line X-X of FIG. 1. The present embodiment shares the same construction as the first embodiment except that openings 26 are provided also in a shield wall 18, so that only the different aspect will be described.

If a largest diameter of the openings 26 provided in the shield wall 18 is denoted by J, then a condition denoted by A≥J is satisfied. Hence, foreign substances that are larger than the diameter of the discharge ports 11 and the diameter of an ink flow path 21 in communication with the discharge ports 11 will not enter into a common liquid chamber B. In addition, the openings 26 provided in the shield wall 18 further improve the capability of ink supply to the discharge ports 11.

(Fourth Embodiment)

Figure 5A:
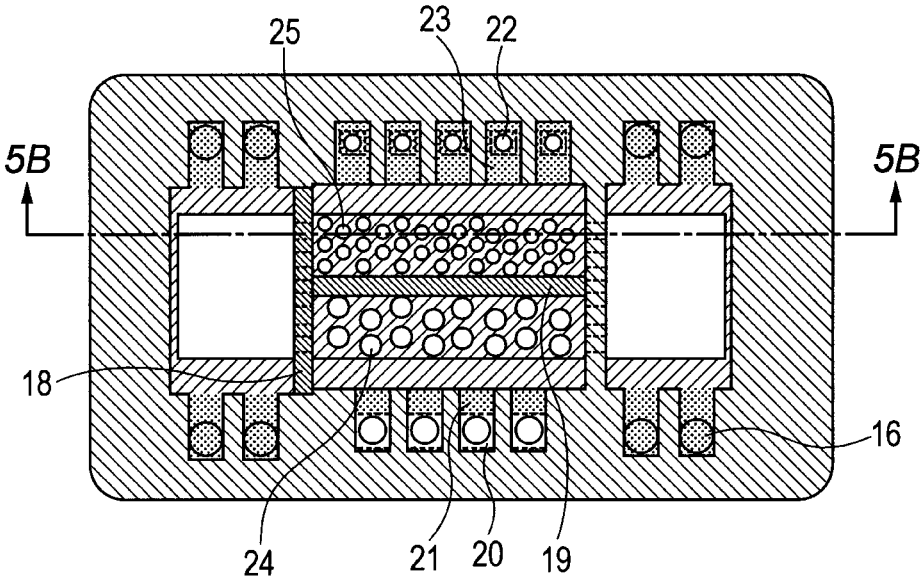
FIG. 5A is a top plan perspective view of an area around a discharge port of an ink jet recording head according to a fourth embodiment.
Figure 5B:
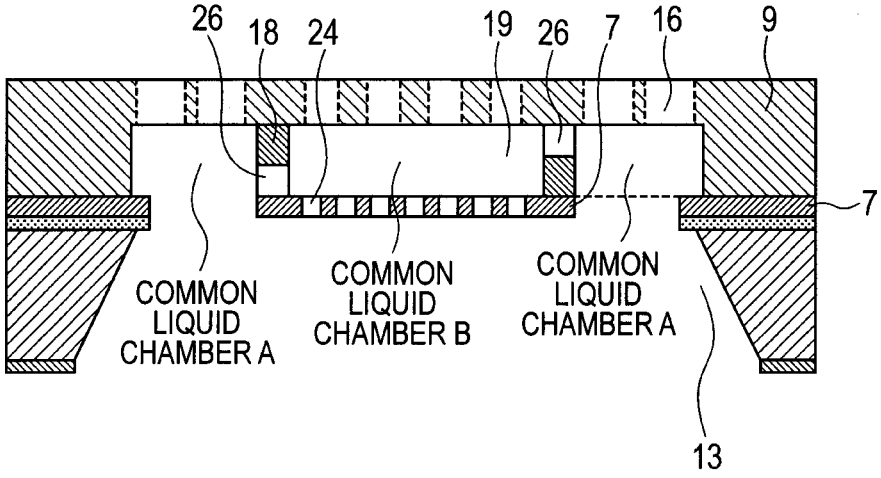
FIG. 5B is a sectional view taken at line 5B-5B of FIG. 5A.

An ink jet recording head according to a fourth embodiment of the present invention will be described with reference to FIGS. 5A and 5B. FIG. 5A is a top plan perspective view of an area around discharge ports of the ink jet recording head according to the present embodiment, and FIG. 5B is a sectional view taken at line 5B-5B of FIG. 5A which also corresponds to a sectional view taken at line X-X of FIG. 1. The present embodiment shares the same construction as the second embodiment except that openings 26 are provided also in a shield wall 18, so that only the different aspect will be described.

If a largest diameter of the openings provided in the shield wall 18 in the area of the row of first discharge ports is denoted by K, then a condition denoted by D≥K is satisfied. If a largest diameter of the openings provided in the shield wall 18 in the area of the row of second discharge ports is denoted by L, then a condition denoted by F≥L is satisfied. This allows foreign substances that have passed through the openings provided in the shield wall 18 to pass through a narrowest portion in the path from ink flow paths 23 to first discharge ports 22 and from an ink flow paths 21 to second discharge ports 20, so that clogging by the foreign substances will not occur. In addition, the openings provided in the shield wall 18 permit an improved capability of ink supply to the first discharge ports 22 and the second discharge ports 20.

Preferably, if a smallest diameter of the openings provided in a filter 7 in the area of the row of the first discharge ports is denoted by M, then a condition denoted by M≥K is satisfied, and if a smallest diameter of the openings provided in the filter 7 in the area of the row of the second discharge ports is denoted by N, then a condition denoted by N≥L is satisfied.

Manufacturing Method of the Ink Jet Recording Head

Referring to FIGS. 6A to 6G, the method for fabricating the ink jet recording head according to the first and the second embodiments will be described. FIGS. 6A to 6G are the sectional views taken at line Y-Y of FIG. 2A, which also corresponds to a sectional view taken at line X-X of FIG. 1, to illustrate individual steps of a method for manufacturing the ink jet recording head according to the first embodiment.

Figure 6A:
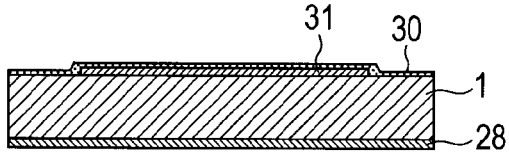
FIGS. 6A, 6B, 6C, 6D, 6E, 6F and 6G are sectional views taken at line Y-Y of FIG. 2A to illustrate individual steps of a method for manufacturing the ink jet recording head according to the first embodiment.

As illustrated in FIG. 6A, a substrate 1 formed of silicon having a crystal orientation of <100> is prepared, and a sacrifice layer 31 for forming a plurality of energy generating elements (not shown), an electrical signal circuit (not shown), and an ink supply port is deposited on one surface of the substrate 1. Any material may be used for the sacrifice layer 31 as long as it can be etched using alkaline aqueous solution. For example, aluminum or polysilicon may be used, or an aluminum-containing chemical compound, such as aluminum silicon, aluminum copper, or aluminum silicon copper, may be used. Further, a SiN layer 30 is deposited on the entire top surface of the sacrifice layer 31 as a protective layer for the energy generating elements and the electrical signal circuit. Then, an etching mask 28 required for the process of anisotropic etching, which will be discussed later, is deposited on the other surface of the substrate 1. For the etching mask 28, a thermally-oxidized film formed in a thermal oxidizing step in a semiconductor manufacturing process or a SiN layer produced by plasma CVD or the like is preferably used. There is no particular restriction on the material for the etching mask 28 as long as the material survives an anisotropic etching liquid (e.g., resist), and there is also no particular restriction on the manufacturing method thereof.

Figure 6B:
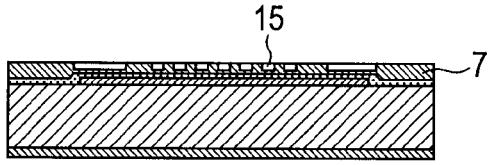

Subsequently, as illustrated in FIG. 6B, a filter 7 is formed on the aforesaid one surface of the substrate 1. As the material for the filter 7, a polyether amide resin, which is a thermoplastic resin, is preferably used to permit improved adhesion to a flow path member 9. The material of the filter 7 is applied to the top surface of the substrate 1 by spin coating or the like, and a positive-type resist (not shown) is patterned thereon. After that, the filter 7 is etched by using the patterned positive-type resist as a mask to form openings 15 in the filter 7.

Figure 6C:
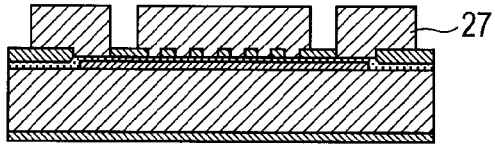

Then, as illustrated in FIG. 6C, a mold layer 27 made of a dissolvable resin material for forming ink flow paths 21 (not shown in FIG. 6C) is applied to the aforesaid one surface of the substrate 1 and patterned according to the configurations of the ink flow paths 21 and the shield wall 18. The supporting member 19 in the second embodiment can also be formed by patterning the mold layer 27 in the present process, as with the ink flow paths 21 and the shield wall 18.

Figure 6D:
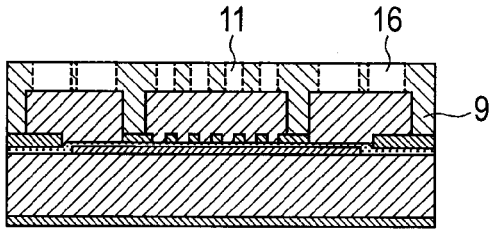

Next, as illustrated in FIG. 6D, the flow path member 9 is deposited on the aforesaid one surface of the substrate 1 such that it covers the mold layer 27, thereby forming the ink discharge ports 11 and the drainage ports 16. For the flow path member 9, a photosensitive material can be used, and the ink discharge ports 11 and the drainage ports 16 can be patterned by exposure and development.

Figure 6E:
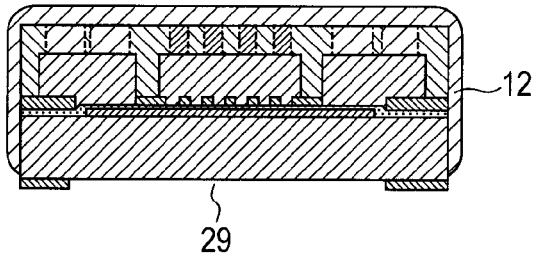

After that, as illustrated in FIG. 6E, a bottom surface opening area 29 corresponding to the ink supply port 13 is removed, leaving a part of the etching mask 28. Further, the substrate 1 is covered with a protective layer 12 to protect a portion other than a desired portion of the substrate 1 from being damaged by the alkaline aqueous solution in the etching process of the substrate 1, which will be discussed hereinafter.

Figure 6F:
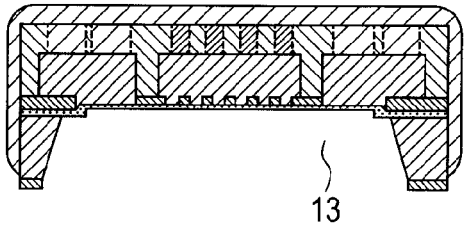

Then, as illustrated in FIG. 6F, anisotropic etching with an alkaline aqueous solution is carried out, using the etching mask 28 as the etching mask, to partially remove the substrate 1, thereby forming the ink supply port 13.

Figure 6G:
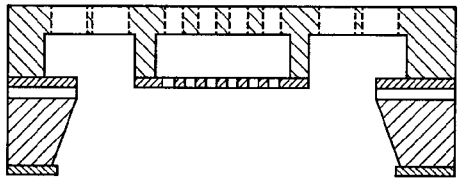

In the next step, as illustrated in FIG. 6G, the SiN layer 30 in the area of the ink supply port 13 and the protective layer 12 are removed and then lastly the mold layer 27 is removed. Thus, the ink jet recording head according to the present embodiments is completed.

Figure 7A:
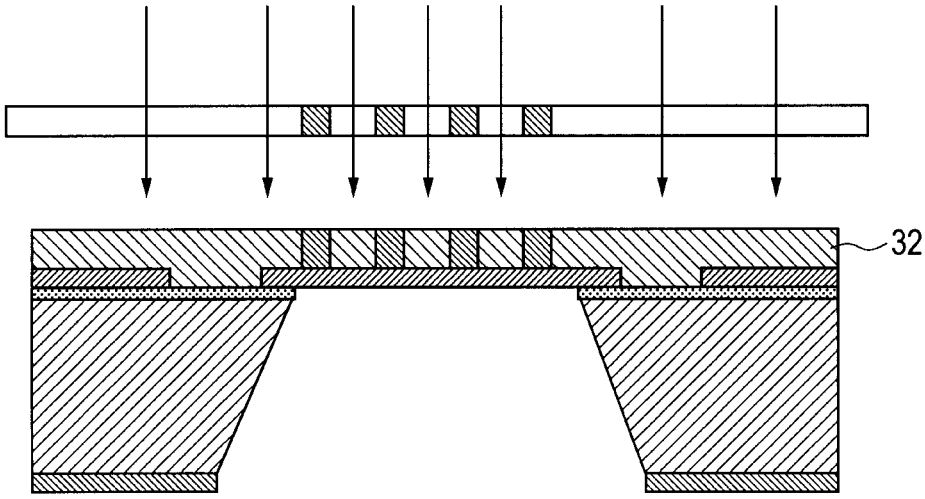
FIGS. 7A and 7B are sectional views taken at line Z-Z of FIG. 4A to illustrate the process for forming openings in a shield wall in a method for manufacturing the ink jet recording head according to the third embodiment.
Figure 7B:
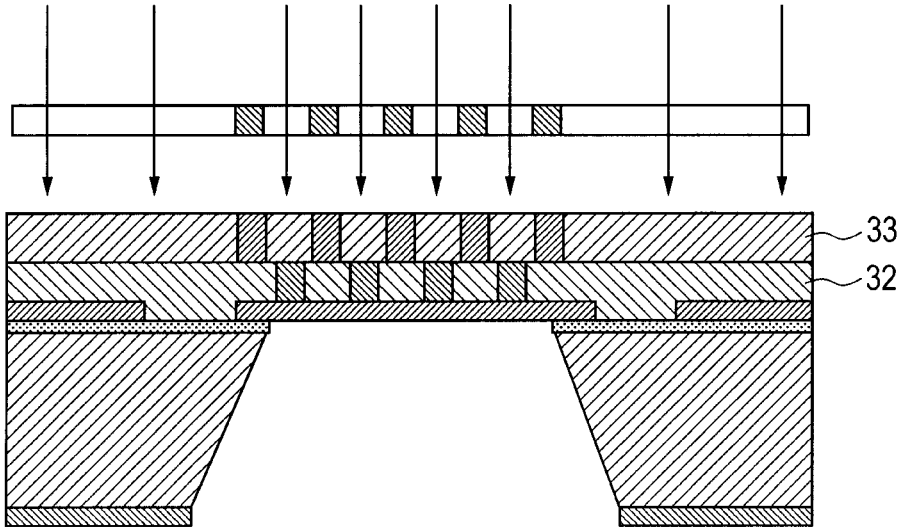

Referring now to FIGS. 7A and 7B, the manufacturing method of the ink jet recording head according to the third and the fourth embodiments will be described. The manufacturing method is the same as the one illustrated in FIGS. 6A to 6G except for the process for forming the openings 26 in the shield wall 18, so that only the different process will be described. FIGS. 7A and 7B illustrate the process for forming the openings 26 in the shield wall 18 in the manufacturing method of the ink jet recording head according to the third embodiment in terms of the sectional views taken at line Z-Z of FIG. 4A.

In the step for patterning the mold layer 27 in FIG. 6C, the portions corresponding to the openings 26 to be formed in the shield wall 18 are exposed by using a positive-type resist as the mold layer. The remaining portion is exposed in the same manner as that illustrated in FIG. 6C. More specifically, as illustrated in FIG. 7A, a first mold layer 32, which is half the thickness of the mold layer 27 in FIG. 6C, is first applied and then exposed to form the shield wall 18, the openings 26, and the ink flow paths 21. Then, as illustrated in FIG. 7B, a positive-type resist, which is a second mold layer 33 having a different photosensitive wavelength from that of the first mold layer 32 is applied onto the first mold layer 32. At this time, setting the thickness of the first mold layer 32 and the second mold layer 33 together to the same thickness of the mold layer 27 in FIG. 6C causes the height of the ink flow paths 21 to be the same as that in FIG. 6C. Thereafter, the second mold layer 33 is exposed at a different wavelength to form the shield wall 18, the openings 26, and the ink flow paths 21, and then the first mold layer 32 and the second mold layer 33 are developed to remove the photosensitive portions, thereby accomplishing the patterning. As illustrated in FIG. 7B, using the positive-type resists having different photosensitive wavelengths for the first mold layer 32 and the second mold layer 33 protects the first mold layer 32 lying underneath from being affected when the second mold layer 33 is exposed. In this case, the thickness of the first mold layer 32 is the same as that of the second mold layer 33, however, the ratio of these thicknesses is not subject to any particular restrictions.

Subsequently, the same steps of the one illustrated in FIG. 6D and after are carried out to complete the ink jet recording head. In this case, the openings 26 in the shield wall 18 and other portions, including the ink flow paths 21, have been patterned in the same step. Alternatively, however, the shield wall 18 and the openings 26 in the shield wall 18 may be formed in separate step from the step for forming the remaining portions. In this case, although the number of steps increases, the patterning of the remaining portions other than the shield wall 18 and the openings 26 is completed in one exposure. This restrains impaired configuration attributable to alignment, and thus enables to accomplish patterning with higher configuration accuracy.

EXAMPLES

The following will describe examples of the present invention; however, the present invention is not limited thereto.

First Example

An ink jet recording head according to the first embodiment described above was fabricated.

As illustrated in FIG. 6A, a substrate 1 formed of silicon having a crystal orientation of <100> is prepared, and a sacrifice layer 31 for forming a plurality of energy generating elements (not shown), an electrical signal circuit (not shown), and an ink supply port is deposited on one surface of the substrate 1. Aluminum was used for the sacrifice layer 31. A SiN layer 30 was deposited on the entire surface of the sacrifice layer 31 as a protective layer for the energy generating elements and the electrical signal circuit. Then, an etching mask 28 was deposited on the other surface of the substrate 1. For the etching mask 28, a silicon thermally-oxidized film formed in a thermal oxidizing step in a semiconductor manufacturing process was used.

Subsequently, a filter 7 was deposited on the aforesaid one surface of the substrate 1, as illustrated in FIG. 6B. As the material for the filter 7, a polyether amide resin was used. The polyether amide resin was applied to the top surface of the substrate 1 by the spin coating, and a positive-type resist (not shown) was patterned thereon. After that, the filter 7 was etched by using the patterned positive-type resist as a mask to form openings 15 in the filter 7. The thickness of the filter 7 was set to 2 μm.

Then, as illustrated in FIG. 6C, a mold layer 27 made of a dissolvable resin material for forming ink flow paths 21 (not shown in FIG. 6C) was applied to the aforesaid one surface of the substrate 1 and patterned according to the configurations of ink flow paths 21 and a shield wall 18. After that, as illustrated in FIG. 6D, a flow path member 9 was deposited on the aforesaid one surface of the substrate 1 such that it covers a mold layer by using a photosensitive material so as to form discharge ports 11 and drainage ports 16 by exposure and development.

Subsequently, as illustrated in FIG. 6E, a bottom surface opening area 29 corresponding to an ink supply port 13 was removed, leaving a part of the etching mask 28. Further, the substrate 1 was covered with a protective layer 12. Then, as illustrated in FIG. 6F, anisotropic etching with an alkaline aqueous solution was carried out, using the etching mask 28 as the etching mask, to form the ink supply port 13 in the substrate 1. In the next step, as illustrated in FIG. 6G, the SiN layer 30 in the area of the ink supply port 13 and the protective layer 12 were removed and further the mold layer 27 was removed. Thus, the ink jet recording head was fabricated. When the smallest diameter among the diameters of the discharge ports 11 and the diameters of the ink flow paths 21 was denoted by A and the largest diameter of the openings 15 was denoted by B, the ink jet recording head satisfied a condition denoted by A≥B.

Second Example

An ink jet recording head according to the third embodiment was fabricated. The same process as that in the first example was used except for the step illustrated in FIG. 6C of the first example, so that only the different step will be described.

FIGS. 7A and 7B are sectional views taken at line Z-Z of FIG. 4A. As illustrated in FIG. 7A, a positive-type resist was applied to form a first mold layer 32 and exposure was carried out to form a shield wall 18, openings 26, and ink flow paths 21. Then, as illustrated in FIG. 7B, a positive-type resist having a different photosensitive wavelength was applied onto the first mold layer 32 to form a second mold layer 33 having the same thickness as that of the first mold layer 32. The second mold layer 33 was exposed at a different wavelength from that of the aforesaid exposure to form the shield wall 18, the openings 26, and the ink flow paths 21. Thereafter, the first mold layer 32 and the second mold layer 33 were developed to remove photosensitive portions so as to accomplish patterning. Thus, the ink jet recording head was fabricated.

The present invention provides a highly reliable ink jet recording head capable of maintaining ink supply performance over a long period of time.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-272470, filed Dec. 7, 2010, which is hereby incorporated by reference herein in its entirety.

What is claimed is:

1. An inkjet recording head comprising:

a substrate provided with a plurality of energy generating elements for discharging ink and an ink supply port for supplying ink to the energy generating elements; and a flow path member which has a plurality of discharge ports for discharging the ink corresponding to the plurality of energy generating elements, a plurality of ink flow paths in communication with the plurality of discharge ports, and a common liquid chamber in communication with the plurality of ink flow paths, wherein the common liquid chamber is divided by a shield wall into a discharge port area communicating with the discharge ports and a drainage port area communicating with drainage ports through which the ink is drained, the ink flows into the discharge port area through a filter, in a case where a smallest diameter among diameters of the discharge ports and diameters of the ink flow paths is denoted by A and a largest diameter of openings of the filter is denoted by B, A≥B is satisfied, and the ink does not flow into the drainage port area through the filter.

2. The inkjet recording head according to claim 1, wherein the filter contains a polyether amide resin.

3. The ink jet recording head according to claim 1, wherein the plurality of discharge ports consists of a row of first discharge ports and a row of second discharge ports for discharging liquid droplets that are larger than liquid droplets discharged from the first discharge ports, and the ink supply port is provided at a position between the row of the first discharge ports and the row of the second discharge ports, the discharge port area of the common liquid chamber is divided by a supporting member into a first discharge port row area communicating with the row of the first discharge ports and a second discharge port row area communicating with the row of the second discharge ports, in a case where a smallest diameter among the diameters of the first discharge ports and the diameters of the ink flow paths in communication with the discharge ports is denoted by D and a largest diameter of the openings provided in the filter in the first discharge port row area is denoted by E, D≥E is satisfied, and in a case where a smallest diameter among the diameters of the second discharge ports and the diameters of the ink flow paths in communication with the discharge ports is denoted by F and a largest diameter of the openings provided in the filter in the second discharge port row area is denoted by G, F≥G is satisfied.

4. The ink jet recording head according to claim 3, wherein in a case where a largest diameter of the openings provided in the filter in the second discharge port row area is denoted by H, and the largest diameter of the openings provided in the filter in the first discharge port row area is denoted by I, H≥I is satisfied.

5. The ink jet recording head according to claim 3, wherein at least one opening is provided in the shield wall, and in a case where a largest diameter of the opening provided in the shield wall in the first discharge port row area is denoted by K, D≥K is satisfied, and in a case where a largest diameter of the opening provided in the shield wall in the second discharge port row area is denoted by L, F≥L is satisfied.

6. The ink jet recording head according to claim 5, wherein in a case where a smallest diameter of the openings provided in the filter in the first discharge port row area is denoted by M, M≥K is satisfied, and in a case where a smallest diameter of the openings provided in the filter in the second discharge port row area is denoted by N, N≥L is satisfied.

7. The ink jet recording head according to claim 1, wherein at least one opening is provided in the shield wall, and in a case where a largest diameter of the opening provided in the shield wall is denoted by J, A≥J is satisfied.

8. The ink jet recording head according to claim 1, wherein in a case where a largest diameter of the drainage ports is denoted by O, O>A applies.

* * * * *